United States Patent [19]

Ichisawa

[11] Patent Number: 4,925,324

[45] Date of Patent: May 15, 1990

[54] COLOR INK RIBBON FOR THERMAL PRINTER

[75] Inventor: Toshinori Ichisawa, Takizawa, Japan

[73] Assignee: Alps Electric Co., Ltd., Tokyo, Japan

[21] Appl. No.: 239,149

[22] Filed: Aug. 30, 1988

[30] Foreign Application Priority Data

Oct. 2, 1987 [JP] Japan ..... 62-247997
Oct. 2, 1987 [JP] Japan ..... 62-247999

[51] Int. Cl.[5] ..... B41J 31/05

[52] U.S. Cl. ..... 400/240.3; 400/240.4; 400/241.4

[58] Field of Search ..... 400/240.3, 241, 241.1, 400/241.4, 120, 241.2, 240.4

[56] References Cited

U.S. PATENT DOCUMENTS 4,588,315 5/1986 Seto et al. ..... 400/120
4,620,199 10/1986 Tatsuni et al. ..... 400/120 X
4,666,320 5/1987 Kobayashi et al. ..... 400/241.1
4,672,393 6/1987 Uchikata et al. ..... 400/241.2 X
4,675,063 6/1987 Mech et al. ..... 400/241.1 X
4,744,685 5/1988 Meche et al. ..... 400/241.4
4,756,633 7/1988 Drees et al. ..... 400/241.1 X

FOREIGN PATENT DOCUMENTS 189574 8/1986 European Pat. Off. ..... 400/240.3
192689 10/1985 Japan ..... 400/241.1
204387 10/1985 Japan ..... 400/241.1
178529 5/1986 Japan ..... 400/241.1

*Primary Examiner*—Edgar S. Burr
*Assistant Examiner*—Ren Yan
*Attorney, Agent, or Firm*—Guy W. Shoup; Paul J. Winters

[57] ABSTRACT

In a color ink ribbon for use with a thermal printer, including a base, a plurality of ink layers having different colors formed on the base and arranged at intervals in a longitudinal direction of the base, and a plurality of markers for detecting the colors of the ink layers, each marker being formed on the base and arranged just upstream of each corresponding ink layer in a moving direction of the color ink ribbon in longitudinally spaced relationship to the adjacent ink layers, the improvement comprising a base covering layer for entirely covering an upper surface of the base in such a manner that the base covering layer is interposed between the base and the ink layers as well as the markers, the base covering layer having a coefficient of friction not less than that of said ink layers. In another aspect, the improvement comprising an overcoat layer for covering the ink layers, the markers and an exposed upper surface of the base, the overcoat layer having a coefficient of friction not less than that of the ink layers.

4 Claims, 3 Drawing Sheets

COLOR INK RIBBON FOR THERMAL PRINTER

BACKGROUND OF THE INVENTION

The present invention relates to an ink ribbon for use with an output device such as a thermal printer, and more particularly to a color ink ribbon having a plurality of color ink layers alternately arranged, so as to carry out desired color printing.

Conventionally, there is known such a color thermal printer using a color ink ribbon having a plurality of color ink layers alternately arranged so as to carry out desired color printing.

FIGS. 3A and 3B show a conventionaI color ink ribbon for use with such a color thermal printer. A color ink ribbon 1 includes a base 2 formed of a light transmitting material such as polyethylene terephthalate (PETP) and a plurality of ink layers 3A, 3B, 3C . . (which will be hereinafter generally referred to as ink layers 8) having different colors. The ink layers are formed on the base 2 in such a manner as to be arranged longitudinally of the color ink ribbon 1 at internals. The color ink ribbon 1 further includes a plurality of colored markers 4 formed on the base 2 for discriminating the colors of the ink layers 3 with a color sensor 10 to be hereinafter described. Each marker 4 is located upstream of each ink layer 3 in a moving direction of the color ink ribbon 1 in such a manner as to be longitudinally spaced from the adjacent ink layers 3. The markers 4 have different lengths corresponding to the colors of the ink layers 3 located just downstream of the markers 4 in the moving direction of the color ink ribbon 1. The provision of the spaces between each marker 4 and the adjacent ink layers 3 is intended to prevent that when the lengths of the markers 4 are sensed by the color sensor !0 to discriminate the colors corresponding to the markers 4, the color sensor 10 would erroneously sense the ink layers 3 adjacent the markers 4 if the ink layers 3 and the markers 4 were arranged side by side.

FIG. 4 shows an essential part of the thermal printer for carrying out color printing by using the above color ink ribbon 1. The thermal printer includes a cylindrical platen 12 fixed on a rotating shaft 11. A pair of parallel support shafts 13 and 14 are arranged on the front side of the platen 12 fur supporting a carriage 15 movable along an axial direction of the platen 12. The carriage 15 is connected to a wire (not shown) adapted to be moved through rotation of pulleys by driving a motor. Thus the carriage 15 Is adapted to be reciprocated along the platen 12 while being supported to the support shafts 13 and 14.

The carriage 15 is provided with a thermal head 16 opposed to the platen 12. A ribbon cassette 17 including the color ink ribbon 1 wound around a pair of spools 18 and 19 is mounted in the carriage 15. The color ink ribbon 1 is exposed outside at an intermediate position between the spools 18 and 19. The color ink ribbon 1 exposed from the ribbon cassette 17 and a paper 20 are sandwiched between the thermal head 16 and the platen 12. In printing operation, a plurality of heat generating elements of the thermal head 16 are selectively activated while moving the carriage 15, thereby melting the ink layers 3 of the color ink ribbon 1 and transferring the molten ink layers 3 onto the paper 20. The color sensor 10 for discriminating the colors of the ink layers 3 with the markers 4 of the color ink ribbon 1 is mounted on the thermal head 16. As shown In FIG. 5, the color sensor 10 comprises a support block 21 having a central groove 22, a light emitting device 23 and a light receiving device 24. The light emitting device 23 and the light receiving device 24 are arranged in opposed relationship to each other on opposite sides of the central groove 22. The color ink ribbon 1 is adapted to pass through the central groove 22 at a uniform speed. Light emitted from the light emitting device 23 is received by the light receiving device 24, and the light is blocked by the markers 4 having different lengths during running of the ink ribbon 1 for different periods of time. Accordingly, these periods of time are detected to discriminate the colors of the ink layers 3 just downstream of the markers 4.

When the thermal head 16 is moved at a uniform speed under the condition that the color ink ribbon 1 exposed from the ribbon cassette 17 and the paper 20 are sandwiched between the thermal head 16 and the platen 12, the color ink ribbon 1 is taken out from the spool 18 in such a manner that slippage of the color ink ribbon 1 may not generated owing to a frictional force between the color ink ribbon 1 and the paper 20. During running of the color ink ribbon 1, the color sensor 10 operates to detect the color of each ink layer 3 according to the length of each marker 4, and when the ink layer 3 of a desired color to be printed reaches a position opposed to the thermal head 16, the plurality of heat generating elements of the thermal head 16 are selectively activated to melt the molten the ink layer 3 and thereby transfer the molten ink of the ink layer 3 onto the paper 20. Thus, the color printing is carried out.

In the conventional color ink ribbon 1 as mentioned above, the base 2 is exposed between each marker 4 and each ink layer 3. The base 2 is formed of a material having a low coefficient of friction such as polyethylene terephthalate as mentioned above. Therefore, when the base 2 is opposed to the paper 20, there is a possibility of the color ink ribbon 1 as well as the thermal head 16 being slid relative to the paper 20. If the color ink ribbon 1 is slid relative to the paper 20, the ink layer 3 cannot reach a position opposed to the thermal head 16 within a predetermined period of time after the color sensor 10 discriminates the color of the ink layer 3 with the corresponding marker 4 of the color ink ribbon 1. As a result, a leading edge of each ink layer 3 cannot be precisely positioned to cause deterioration of printing quality.

SUMMARY OF THE INVENTION

It is an object of the present invention to provide a color ink ribbon which may solve the above problem and ensure precise positioning of the leading edge of each ink layer.

According to a first aspect of the present invention, there is provided in a color ink ribbon including a base, a plurality of ink layers having different colors formed on said base and arranged at intervals in a longitudinal direction of said base, and a plurality of markers for deleting the colors of said ink layers, each marker being formed on said base and arranged just upstream of each corresponding ink layer in a moving direction of said color ink ribbon in longitudinally spaced relationship to said adjacent ink layers, the improvement comprising a base covering layer for entirely covering an upper surface of said base in such a manner that said base covering layer is interposed between said base and said ink layers as well as said markers said base covering layer having a coefficient of friction not less than that of said ink layers. According to a second aspect of the present invention, there is provided in the above color ink ribbon, the improvement comprising an overcoat layer for covering said ink layers, said markers and an exposed upper surface of said base, said overcoat layer having a coefficient of friction not less than that of said ink layers.

With this arrangement, as the base covering layer and the overcoat layer have a coefficient of friction at least equal to that of the ink layers, the base covering layer or the overcoat layer is brought into frictional contact with the paper during running of the color ink ribbon. Accordingly, there is generated no slippage between the color ink ribbon and the paper, thereby ensuring uniform motion of the color ink ribbon and attaining good quality of color printing.

Other objects and features of the invention will be more fully understood from the following detailed description and appended claims when taken with the accompanying drawings.

DETAILED DESCRIPTION OF THE PREFERRED EMBODIMENTS

There will now be described some preferred embodiments of the present invention with reference to the drawings.

Figure 1A:
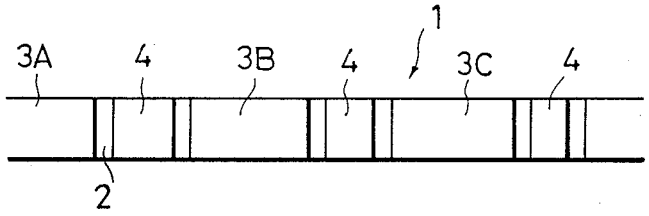
FIG. 1A is a plan view of an essential part of the color ink ribbon according to a first preferred embodiment of the present invention.
Figure 2A:
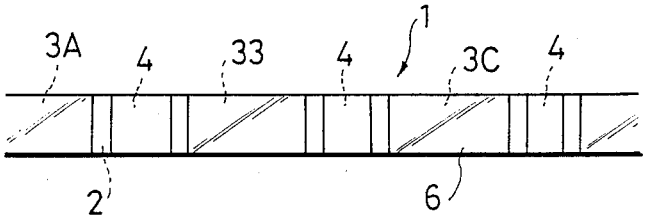
FIG. 2A is a plan view of an essential part of the color ink ribbon according to a second preferred embodiment of the present invention.
Figure 2B:
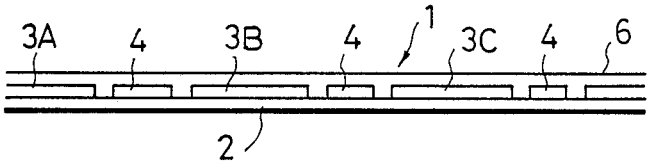
FIG. 2B is an elevational view of FIG. 2A.
Figure 3A:
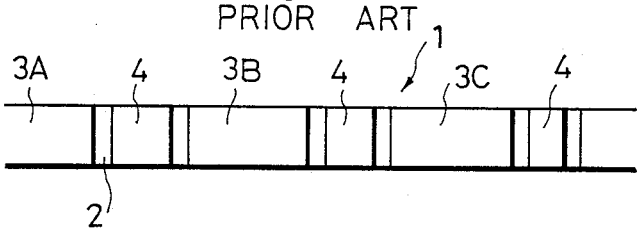
Fig.3(A) PRIOR ART
FIG. 3A is a plan view of an essential part of the conventional color ink ribbon.
Figure 3B:
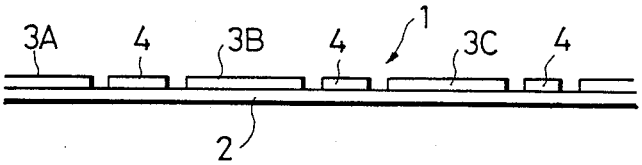
Fig.3(B) PRIOR ART
FIG. 3B is an elevational view of FIG. 3A.
Figure 5:
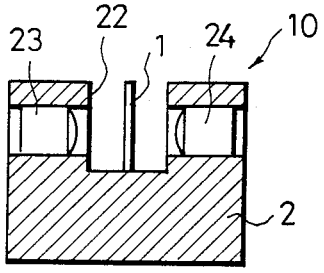
FIG. 5 is an enlarged sectional side view of the color sensor shown in FIG. 4.

FIGS. 1A and 2B show a first preferred embodiment of the color ink ribbon according to the present invention. Reference numeral 1 generally designates a color ink ribbon having a base 2 formed of a material such as polyethylene terephthalate similar to the aforementioned conventional color ink ribbon. A base covering layer 6 having a coefficient of friction not less than that of ink layers 3 to be hereinafter described is formed on the base 2. The base covering layer 5 is colorless and transparent so as not to be detected by the color sensor 10 as shown in FIG. 5. The base covering layer 5 is preferably formed of a resin coating such as low molecular weight polyethylene, polyamide, ethylene vinyl acetate, and ethylene ethyl acrylate, or a wax coating having a penetration of 0–2 such as amide wax, castor wax and carnauba wax. The ink layers 3A, 3B, 3C ... having different colors are formed on the base covering layer 5, and are arranged at intervals in a longitudinal direction of the base 2. The markers 4 are formed on the base covering layer 5, and each marker 4 is arranged in longitudinally spaced relationship to the adjacent ink layers 3 in such a manner that each marker 4 corresponds to the just downstream ink layer 3 in a moving direction of the color ink ribbon 1. Each marker 4 is different in length according to the color of the just downstream ink layer 3.

Figure 1B:
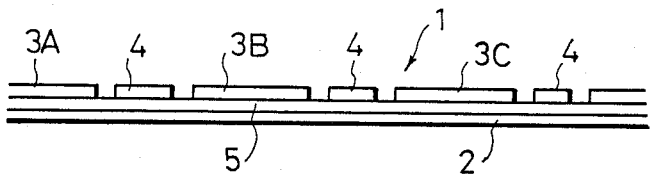
FIG. 1B is an elevational view of FIG. 1A.

In using the printer as shown in FIG. 1 by employing the color ink ribbon as mentioned above, the base 2 of the color ink ribbon 1 does not directly contact the paper 20, but the base coating layer 5 formed on the base 2 contacts the paper 20. As the base covering layer 5 has a coefficient of friction not less than that of the ink layers 3, there is generated no slippage between the color ink ribbon 1 and the paper 20 to thereby ensure uniform motion of the color ink ribbon 1 at all times. Furthermore, as the base covering layer is colorless and transparent, it does not hinder a path of light emitted from the light emitting device 23 to the light receiving device 24 of the color sensor 10, thereby allowing the color sensor 10 to precisely descriminate the colors of the ink layers 3 with the markers 4. As a result, the leading edge of each ink layer 3 may be precisely positioned upon printing to thereby ensure good quality of color printing.

FIGS. 2A and 2B show a second preferred embodiment of the color ink ribbon according to the present invention. The color ink ribbon 1 includes a base 2 formed of a material such as polyethylene terephthalate similar to the aforementioned conventional color ink ribbon, a plurality of ink layers 3A. 3B, 3C ... having different colors formed on the base 2 and arranged at intervals in a longitudinal direction of the base 2, and a plurality of markers 4 formed on the base 2. Each marker 4 is arranged in longitudinally spaced relationship to the adjacent ink layers 3 in such a manner that each marker 4 corresponds to the just downstream ink layer 3 in a moving direction of the color ink ribbon 1. Each marker 4 is different in length according to the color of the just downstream ink layer 3.

An overcoat layer 6 is so formed as to entirely cover the ink layers 3, the markers 4 and exposed upper surfaces of the base 2 in such a manner that an upper surface of the overcoat layer 6 is made flat. The overcoat layer 6 is colorless and transparent so as not to be detected by the color sensor 10 as shown in FIG. 5. The overcoat layer 6 is formed of a material having a coefficient of friction not less than that of the ink layers 3, and it is preferably formed of a resin coating such as low molecular weight polyethylene, polyamide, ethylene vinyl acetate, and ethylene ethyl acrylate, or a wax coating having a penetration of 0–2 such as amide wax, castor wax and carnauba wax.

Figure 4:
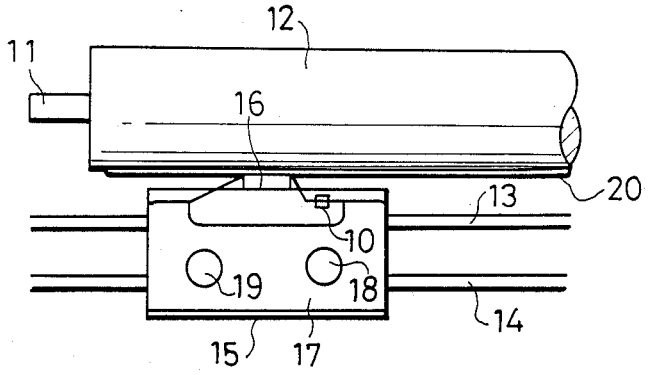
FIG. 4 is a plan view of an essential part of the general color printer employing the color ink ribbon.

In using the printer as shown in FIG. 4 by employing the color or ink ribbon as mentioned above, the overcoat layer 6 of the color ink ribbon 1 contacts the paper 20 at all times. As the base covering layer 5 has a coefficient of friction not less than that of the ink layers 3, there is generated no slippage between the color ink ribbon 1 and the paper 20 to thereby ensure uniform motion of the color ink ribbon 1 at all times. Furthermore, as the overcoat layer 6 is colorless and transparent, it does not hinder a path of light emitted from the light emitting device 23 to the light receiving device 24 of the color sensor 10, thereby allowing the color sensor 10 to precisely descriminate the colors of the ink layers 3 with the markers 4. As a result, the leading edge of each ink layer 3 may be precisely positioned upon printing to thereby ensure good quality of color printing.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a color ink ribbon for use with a thermal transfer printer, including a base, a plurality of ink layers having different colors formed on said base and arranged at intervals in a longitudinal direction of said base, and a plurality of markers for detecting the colors of said ink layers, each marker being formed on said base and arranged just upstream of each corresponding ink layer in a moving direction of said color ink ribbon in longitudinally spaced relationship to said adjacent ink layers, the improvement comprising a wax base covering layer for entirely covering an upper surface of said base in such a manner that said base covering layer is interposed between said base and said ink layers as well as said markers, said base covering layer having a coefficient of friction not less than that of said ink layers.

2. In a color ink ribbon for use with a thermal printer, including a base, a plurality of ink layers having different colors formed on said base and arranged at intervals in a longitudinal direction of said base, and a plurality of markers for detecting the colors of said ink layers, each marker being formed on said base and arranged just upstream of each corresponding ink layer in a moving direction of said color ink ribbon in longitudinally spaced relationship to said adjacent ink layers, the improvement comprising an overcoat layer for covering said ink layers, said markers and an exposed upper surface of said base, said over coat layer having a coefficient of friction not less than that of said ink layers.

3. In a color ink ribbon for use with a thermal transfer printer, including a base, a plurality of ink layers having different colors formed on said base and arranged at intervals in a longitudinal direction of said base, and a plurality of markers for detecting the colors of said ink layers, each marker being formed on said base and arranged just upstream of each corresponding ink layer in a moving direction of said color ink ribbon in longitudinally spaced relationship to said adjacent ink layers, the improvement comprising a base covering layer for entirely covering an upper surface of said base in such a manner that said base covering layer is interposed between said base and said ink layers as well as said markers, said base covering layer having coefficient of friction not less than that of said ink layers.

4. The color ink ribbon as defined in claim 2, wherein said base covering layer is comprised of resin.

* * * * *

UNITED STATES PATENT AND TRADEMARK OFFICE

CERTIFICATE OF CORRECTION

PATENT NO. : 4,925,324

DATED : May 15, 1990

INVENTOR(S) : Toshinori Ichisawa

It is certified that error appears in the above-identified patent and that said Letters Patent is hereby corrected as shown below:

Col. 6 Line 21 - Claim 3 insert --a-- after "having"

Signed and Sealed this

Eleventh Day of June, 1991

*Attest:*

*Attesting Officer*

HARRY F. MANBECK, JR.

*Commissioner of Patents and Trademarks*